US005429222A

United States Patent [19]

Delay

[11] Patent Number: 5,429,222

[45] Date of Patent: Jul. 4, 1995

[54] DEVICE FOR VERIFYING THE CONFORMITY OF AND FOR ROUTING OBJECTS INSERTED IN A DISPENSER

[75] Inventor: Jean-Pascal Delay, Besancon, France

[73] Assignee: Schlumberger Industries, Montrouge, France

[21] Appl. No.: 191,817

[22] Filed: Feb. 4, 1994

[30] Foreign Application Priority Data

Feb. 5, 1993 [FR] France ..... 93 01307

[51] Int. Cl.[6] ..... G07F 1/02

[52] U.S. Cl. ..... 194/343; 194/346; 194/347

[58] Field of Search ..... 194/202, 203, 212, 213, 194/317, 342, 343, 346, 348, 349, 351, 347

[56] References Cited

U.S. PATENT DOCUMENTS

| | | | |
|---|---|---|---|
| 1,619,654 | 3/1927 | Chandler | 194/203 |
| 1,902,210 | 3/1933 | Biniek | 194/351 X |
| 2,069,200 | 2/1937 | Ackley | 194/351 X |
| 2,491,900 | 12/1949 | Mihalek | 194/351 X |
| 4,546,867 | 10/1985 | Terry et al. . | |

FOREIGN PATENT DOCUMENTS

| | | | |
|---|---|---|---|
| 0252466 | 1/1988 | European Pat. Off. | 194/347 |
| 1449195 | 11/1968 | Germany . | |
| 2901937B1 | 5/1980 | Germany . | |
| 3513767 | 10/1986 | Germany | 194/351 |
| 3738393A1 | 5/1989 | Germany . | |
| 0128858 | 11/1928 | Switzerland | 194/351 |
| 0328540 | 5/1930 | United Kingdom | 194/346 |
| 0341544 | 1/1931 | United Kingdom | 194/346 |
| 2236420 | 4/1991 | United Kingdom . | |

*Primary Examiner*—Michael S. Huppert
*Assistant Examiner*—Scott L. Lowe
*Attorney, Agent, or Firm*—Frishauf, Holtz, Goodman & Woodward

[57] ABSTRACT

A device for verifying the conformity of objects, in the nature of coins inserted as payment in a dispenser of products or services through an opening, and for directing the objects toward means for processing the same. The device is of the type comprising a positioning member with a receptacle adapted to receive the object, wherein the member is movable between a first position in which the receptacle communicates with the opening, access to the processing means then being blocked, and a second position in which the receptacle communicates with the processing means, the opening then being blocked.

12 Claims, 8 Drawing Sheets

FIG. 5
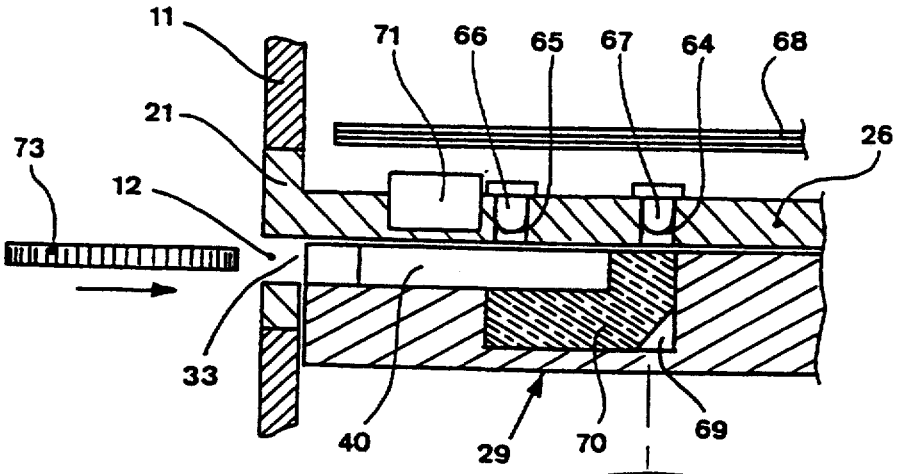
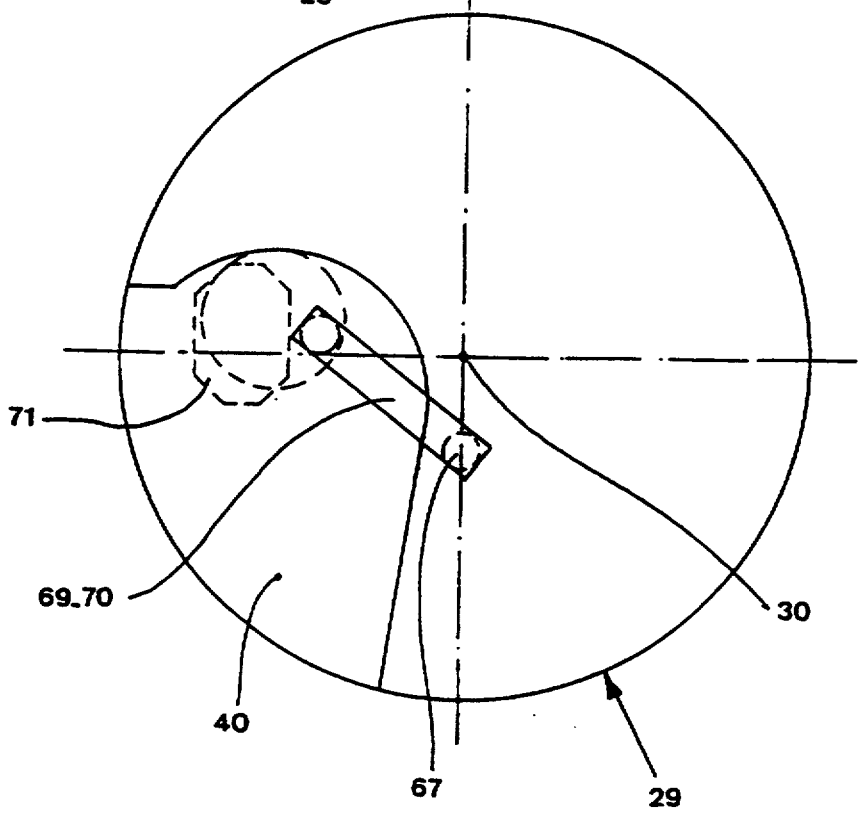
FIG.6

DEVICE FOR VERIFYING THE CONFORMITY OF AND FOR ROUTING OBJECTS INSERTED IN A DISPENSER

FIELD OF THE INVENTION

The present invention concerns a device for verifying the conformity of objects (in the nature of coins) inserted as payment into a dispenser of products or services, and for directing such objects toward means for processing the same.

BACKGROUND OF THE INVENTION

By way of example, the invention can be applied to dispensers for consumable products, such as foodstuffs, or dispensers of services, such as travel tickets or vehicle parking tickets.

Apparatus for dispensing products and services in exchange for payment in coins, hereinafter called "dispensers", generally comprises a front panel provided with an opening in the form of a slot, into which the coins are inserted, and one or more other openings for giving change, for returning coins and/or for delivering the desired product or a ticket. The apparatus usually comprises an enclosure in the form of a rectangular block containing various systems needed for operation of the dispenser, such as a device called the "coin input" a coin selector, a cash box, means for ejecting non-conforming objects, and a return tray for example.

The device called the "coin input" has several functions, such as blocking the insertion slot when the dispensing apparatus is not in use, routing coins to the selector for identifying the respective values of the coins, and ejecting objects inserted in the dispenser if they do not conform to the type of coins accepted by the dispenser apparatus.

The coin input device accordingly comprises various parts, including sensors for allowing a preliminary recognition of inserted objects, either to prevent non-conforming objects from being inserted or, if these objects are nevertheless inserted, to eject them.

The dispensers to which reference is made above are, by definition, located in public places and are thus exposed to acts of vandalism and/or fraud. Withstanding vandalism requires high mechanical strength for the dispenser, especially in the region of its openings, and more particularly its coin input.

Fraud also constitutes a major problem with this type of dispenser. For example, attempts are made to introduce a coin attached to a wire or the like, in order to release operation of the apparatus and then to recover the coin thus inserted. Attempts are also made to introduce objects resembling coins, either in their shape or their composition. Instances of blocking coin insertion are also encountered, which are done in order to recover coins subsequently inserted by other customers who abandon their money thus inserted without obtaining the consideration (i.e. product or ticket) for their payment. The fraudster then unblocks the system and recovers the inserted coins and/or obtains the consideration in product and/or service. Attempts are also made to introduce foreign materials, such as liquids (for example acid), in order to block or put out of action the electronic means controlling the dispenser, which can thus be put in a state of permanently dispensing or giving change.

The few examples above show the difficulty of protecting such dispensers. It is, thus, desirable to prevent access to the system for transporting the coin between the slot through which it is inserted and the coin selector which effects coin identification, apart from access by authorized persons.

Various attempts have been made to overcome the above problems. The simplest type of known dispenser does not comprise any detection means and comprises a flap mounted to rotate between a first position in which it blocks a slot for introducing coins, and a second, retracted position in which the opening is open and allows the insertion of a coin. The opening and closing of the flap is effected by a central unit, adapted to free the opening when, for example, the conditions of payment and selection of products and services have been correctly entered by the user.

That relatively rudimentary known device suffers from problems. In the first place, it allows access to the interior of the apparatus very easily, once the flap is open and, in particular, access to the coin path, which can thus be blocked, or through which a captive coin, such as mentioned above, can be inserted. Equally, it offers no recognition of inserted objects.

Attempts have been made to improve the device referred to above and coin input devices are known comprising a sensor, of inductive type for example, located in the vicinity of the slot and adapted to trigger the command for opening the coin insertion opening, via the central unit.

Although it does allow some clearly non-conforming objects to be eliminated, such as a disk of cardboard, that device is nevertheless limited to one characteristic only of the introduced object. Moreover, once the flap is retracted by the sensor command, it allows the slot to open and, thus, gives access to the interior of the dispenser, with the damaging consequences referred to above. Furthermore, the proximity of the sensor to the coin insertion slot makes the sensor very vulnerable to damage by insertion through the slot of an object such as a screwdriver or the like, thus putting the sensor out of action.

The two types of coin input devices of known type, referred to above, are sometimes associated with gravity feed means for the inserted coins, from the coin inlet to the selector. The gravity feed means are generally formed by an inclined ramp, in the form of a chute. The chute can be of simple type, in which case it feeds the coin directly by rolling the coin, or it can be of the type called "dynamic", which is provided with test means allowing inserted objects to be tested according to their dynamic characteristics, coins following a predetermined path arriving at the selector, while the non-conforming objects are sensed and ejected before they arrive at the selector. Although this ejection is advantageous in itself, it is not always satisfactory in the way in which it is effected downstream of the coin input device and thus inside the apparatus, where damage can already have been done by inserted non-conforming objects, in particular corrosive liquids. Moreover, the ramps or chutes which feed by gravity occupy a non-negligible height. However, the constraints involved in use of dispensers, especially by handicapped persons, restrict the height of the slot above the ground to 1.30 meters at the most. Also, dispensers for use by non-handicapped persons should have a discharge device for return of coins, or change, or of a ticket, located at a height above the ground of at least 0.65 meters. This, thus, limits the overall height and the size of dispenser means and systems to a maximum height dimension of 0.65 meters. However, gravity systems use up a large fraction of this height simply to feed coins from the coin inlet to the selector.

A third type of coin input device has been proposed, especially for parking meter type apparatus, comprising two flaps adapted to be moved between an edge-to-edge first position in which they block access to the coin input device, and a second position in which they are separated from one another and thus allow an inserted object to penetrate into the coin input device. The opening command for the two flaps is provided by the object itself, by means of a cam, of which one end bears against the edge of the coin or inserted object and the other end is associated with a mechanism adapted to effect the separation of the two flaps, thus providing access to the coin input device if the inserted object conforms in its dimensions as sensed by the movement of the cam.

That device does allow an improvement in the access conditions to the coin path but it does not have any means for detecting and validating the inserted objects apart from by their shape. Note also the relative vulnerability of the flap, which can be held in the open position by mechanical means or adhesive. It is also noted that this disadvantage applies to the two first known devices mentioned above, in which the flap is rotatably mounted. Blocking the flap in open position in an unauthorized manner gives access to the interior of the machine and, thus, allows fraudulent operations already referred to above to be carried out.

A fourth type of coin input device is known comprising a disk rotatably mounted on the outside of the apparatus, the rotation being effected by the user once the inserted coin is in a receptacle provided in the disk, the coin being located in the plane of the disk. The rotation of the disk causes movement of the coin or inserted object in front of a sensor and feeds the coin toward a selector and/or a cash box. A variant of this type of device comprises a slider provided with a receptacle facing the slot in a first position of the slider and facing the selector in a second position of the slider.

That type of device can prevent access to the coin path during the transport of the coins between the coin input and the selector. However, it suffers above all from the disadvantage that it does not allow an inserted foreign body to be rejected, with the difficulties and damaging consequences that can result for the operation of the dispenser. In addition, that type of device is vulnerable and sensitive to external conditions, such as ice and dust. Moreover, since the device is located on the outside, there is an increased vulnerability to vandalism. Finally, recognition by the sensor is only effected once the inserted object is on its path towards the selector or the cash box.

SUMMARY OF THE INVENTION

The invention provides a coin input device making it possible to ensure detection and ejection of non-conforming objects, and it does this well in advance of the coin path, while still ensuring reliable detection based on at least two criteria, in order to prevent access to the coin path when non-conforming objects are inserted and/or in the case of any unauthorized maneuvers.

To this end, according to the invention, the device for verifying the conformity of objects, in the nature of coins inserted as payment in a dispenser of products or services through an opening, and for directing the objects towards means for processing the same, the device being of the type comprising a positioning member with a receptacle adapted to receive the object, wherein the member is movable between a first position in which the receptacle communicates with the opening, access to the processing means then being blocked, and a second position in which the receptacle communicates with the processing means, the opening then being blocked.

The receptacle adapted to receive the said object thus forms a lock chamber.

Preferably, the member is mounted to rotate about an axis transverse to the plane of the objects and, more particularly, it is constituted by a disk provided with a recess opening at the periphery of the disk over an angular sector corresponding to the opening, the remainder of the periphery of the disk being adapted to block the opening when the recess is not facing the slot, and the disk being rotated through an arc of a circle, between the first and second positions referred to above.

The disk advantageously comprises two substantially diametrically opposed recesses.

The disk is preferably adapted to be moved in the two possible senses of rotation.

The device also comprises means for verifying objects, such as an inductive sensor and an optical sensor, preferably facing the receptacle when the latter communicates with the opening.

The device advantageously comprises means of communication between the receptacle receiving the object and means for ejecting non-conforming objects, and these means of communication preferably include a duct opening at one end into the receptacle adapted to receive the object and, at the other end, at the periphery of the disk.

BRIEF DESCRIPTION OF THE DRAWINGS

The invention will be better understood in the light of the following description of an embodiment of the invention, given by way of non-limiting example and with reference to the accompanying drawings, in which:

FIG. 5 shows the sensors and their disposition in detail;

FIG. 6 is a side view of the rotary disk, showing the location of the sensors relative thereto;

DETAILED DESCRIPTION OF THE INVENTION

Figure 1:
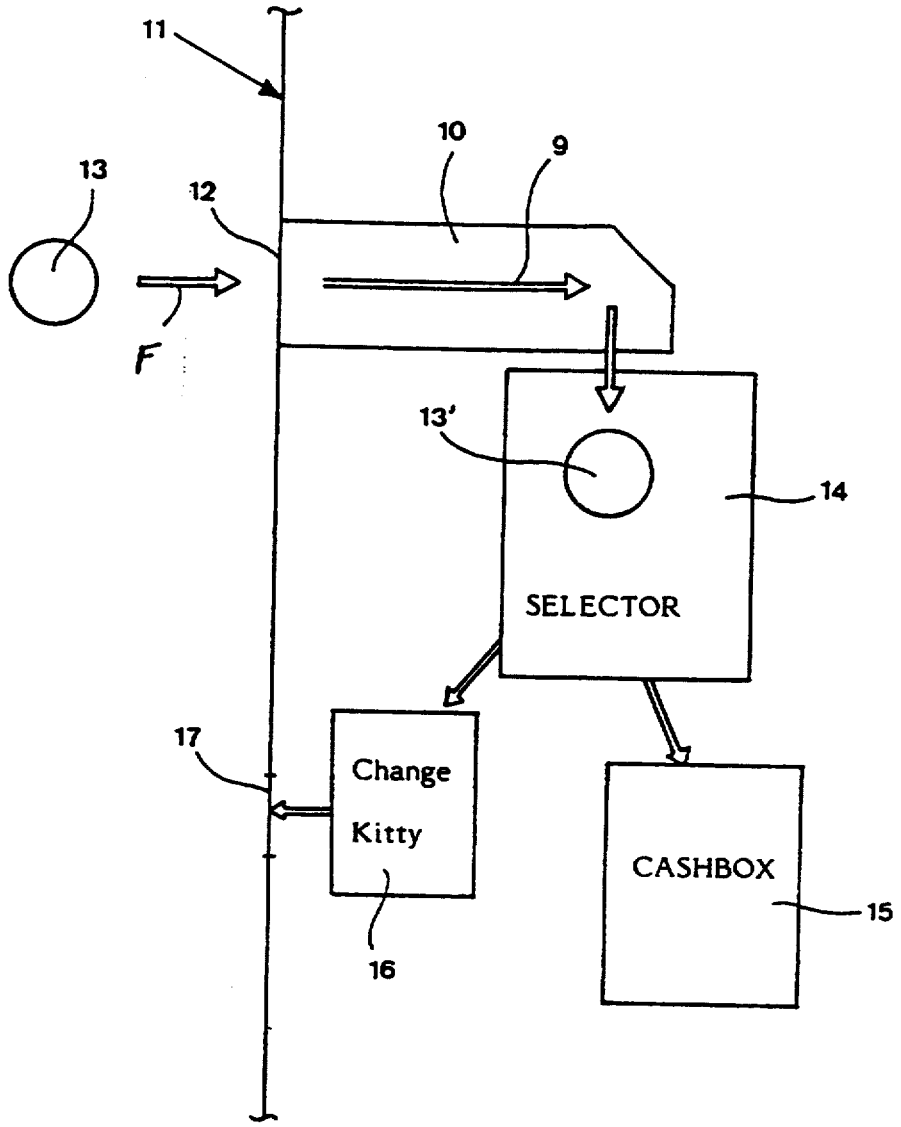
FIG. 1 shows in schematic manner the role of the coin input device in a dispenser.

FIG. 1 shows schematically the location of the device of the invention given general reference 10 and referred to above as the "coin input", being located inside a dispenser apparatus, e.g. a ticket dispenser, of which a part of the front panel 11 is shown. The coin input 10 faces an opening in the form of a slot 12 provided in the front panel 11. It will be understood that, in the example of FIG. 1, the inside of the apparatus is on the right of the panel 11 while the part on the left of the panel 11 corresponds to the outside of the dispenser apparatus. A coin 13 can be inserted through the slot 12 (arrow F). The role of the coin input 10 is to verify conformity of the inserted object by pre-recognition, that is to say to verify that it is a coin or at least that it possesses some of the main characteristics thereof, for example the substance of which it is made. The coin input 10 also has the role, as represented schematically by the arrow 9, of feeding the coin, once its conformity has been established, to a device 14 called the "selector" and in which the coins 13' are tested. The selector 14 is generally connected both to a cash box 15 and to a tray 16 for giving change and opening into an aperture 17 provided in the front panel 11 of the dispenser. The dispenser comprises other systems and devices needed for its operation, which are not shown and which are known in themselves, such as means for selecting the travel ticket desired by the user, a central unit adapted to supply a travel ticket once the payment has been effected and verified, and means for printing a ticket and for delivering it via an opening provided in the front panel of the dispenser. Since the selector 14, the cash box 15 and the change tray 16 are known per se, they are not shown in detail.

Figure 2A:
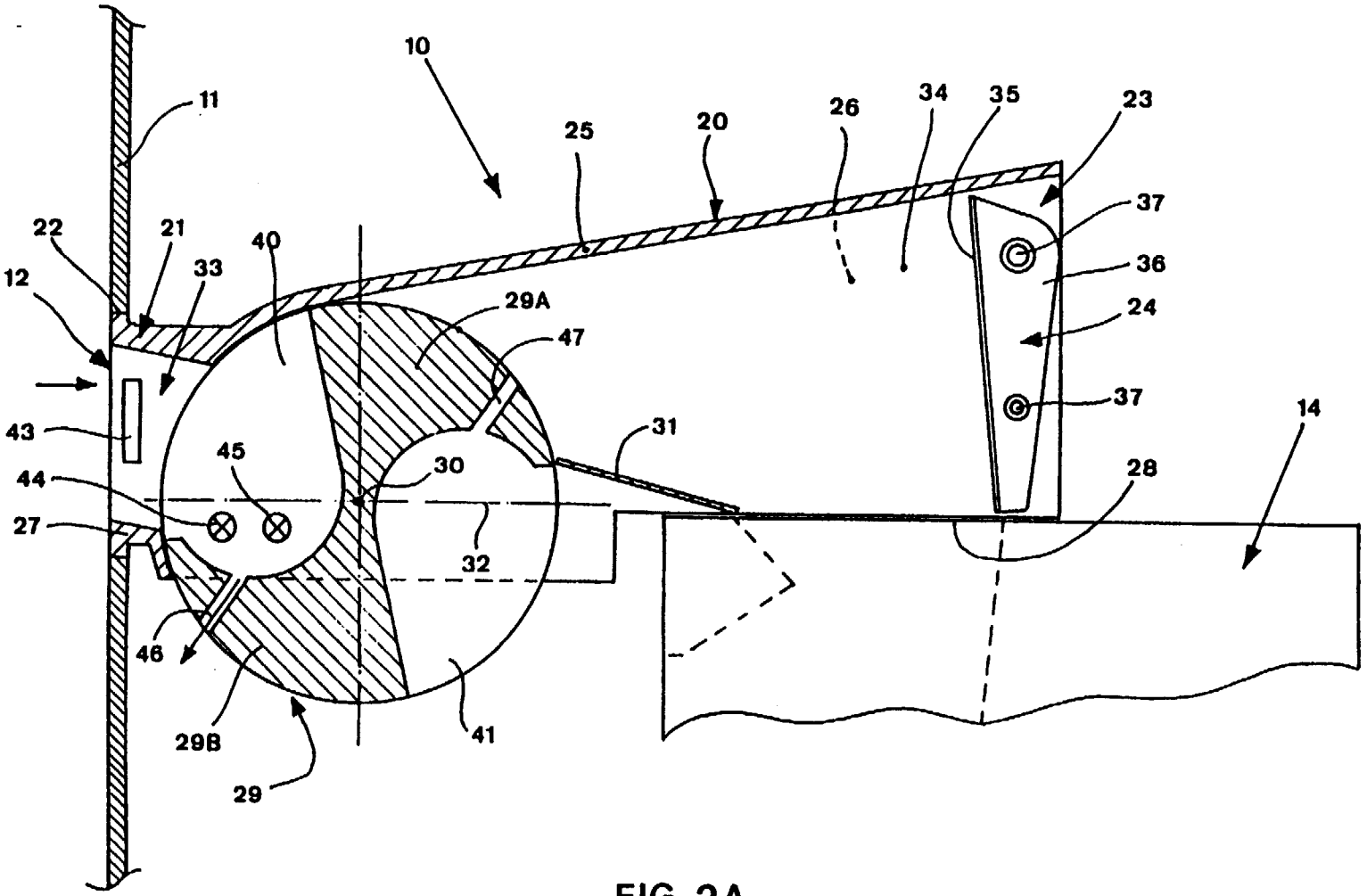
FIG. 2A is a longitudinal section of the coin input of the invention on a plane passing through the coin inlet.

The coin input forming the subject of the present invention is now described in more detail, with reference initially to FIG. 2A showing a longitudinal section of the coin input device.

Referring to FIG. 2A, the coin input 10 comprises a box 20 of generally elongate shape and whose axis is substantially perpendicular to the front panel 11 of the dispenser. The box 20 is open at both ends, i.e. at a first end 21 adapted to be fixed in a complementary opening 22 provided in the front panel 11 and corresponding to the coin insertion slot 12, and at a second end 23 blocked by a part 24 described in detail below.

The box 20 comprises a top panel 25, and two side panels of which one is shown, namely the panel 26 in FIG. 2A. The three top and side panels thus bound a generally U-shaped box as seen in a right section. The first end 21 adjacent the front panel 11 has a generally cylindrical shape on a rectangular base and corresponding to the aperture 22 in the front panel 11, and comprises to this end a bottom wall 27 which extends a little way from the front panel 11 towards the interior of the apparatus. Thus, the lower part of the box is open downwardly over the major part of the box 20. One segment of the lower part of the box 20 is located near to and above a coin selector 14 known per se and not shown in detail and provided with a top opening 28 facing the lower, open part of the box 20, alongside the second end 23 of the box 20.

Inside the box 20 is located a disk 29 rotatably mounted on the sidewalls of the box 20 on an axis of rotation 30 transverse to the longitudinal direction of the box 20 and substantially parallel to the plane of the coin insertion opening 12 and, thus, to the plane of the front panel 11.

The disk 29 is disposed inside the box 20 in such a manner that it fits snugly, preferably around an arc of a circle, against the inner surface of the top wall 25 of the box 20 and in such a manner that it likewise fits snugly against the far end of the bottom part 27 of the end 21 of the box 20 alongside the front panel 11.

A plate 31 is located between the disk 29, substantially in the region of a diameter of the same, and the edge of the opening 28 of the selector 14. The plate 31 is arranged substantially in the longitudinal direction of the box 20 and preferably in a direction inclined slightly downwardly relative to the longitudinal axis of the box 20 denoted by the straight line 32.

Thus, the box 20 and the parts disposed therein comprise, in succession, from the front panel 11: an insertion chute 33 for receiving the coin inserted through the slot 12, the disk 29 and finally a release space 34 inside the box 20 and having the shape of a cylinder on a rectangular base. The inner space 34 is bounded by the top wall 25, the disk 29, the plate 31, the opening 28 of the selector 14 and the part 24. The latter comprises a panel 35 substantially transverse to the top panel 25 of the box 20 and blocking the second end 23 of the box 20 (opposite to the front panel 11). The panel 35 is for example continued by a flange 36 at right angles and fixed to one of the side panels by rivets 37. It should be noted that the blocking panel 35 is so positioned that its lower end faces and is near the remote end of the opening 28 of the selector 14. In addition the blocking panel 35 is disposed in a plane substantially perpendicular to the plane of the opening 28, which is itself substantially perpendicular to the front panel 11.

Figure 2B:
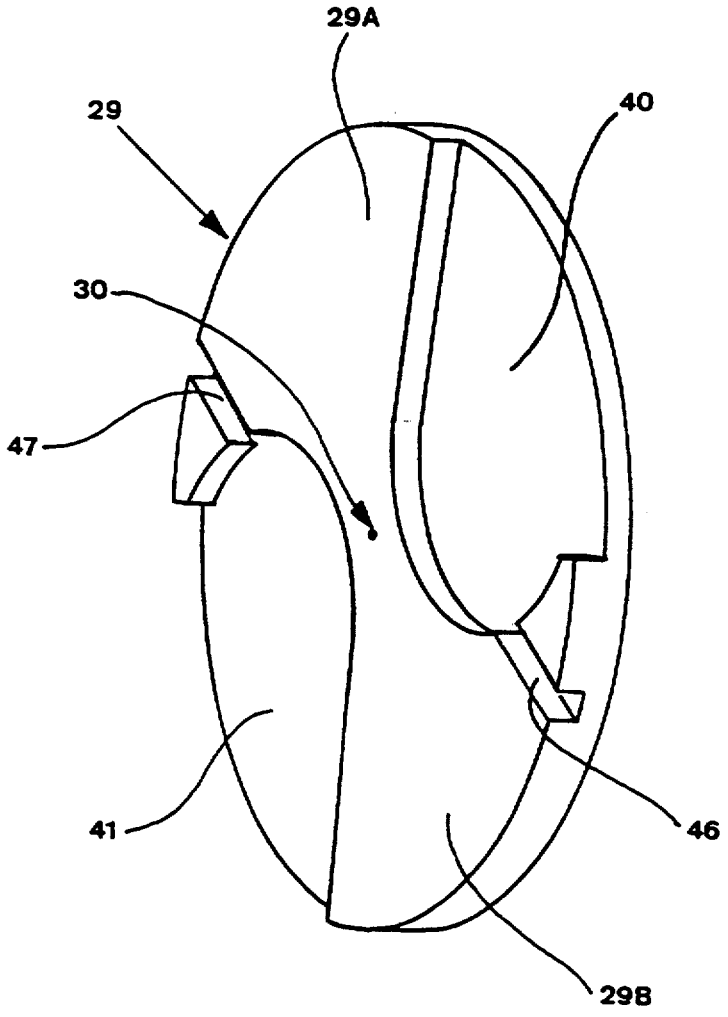
FIG. 2B is a perspective view of the disk.

The disk 29 has a recess 40, preferably two recesses 40 and 41, that are generally J-shaped as seen in right section in the plane of the disk. The edge of each recess opens at the periphery of the disk 29. The lower part of each recess is generally semicircular with a diameter substantially equal to the largest of the coins which can be accepted in the dispenser. The recesses 40 and 41 are separated by solid parts 29A and 29B adapted to block the coin insertion chute 33. FIG. 2B is a perspective view of the disk. The disk 29 comprises two channels 46 and 47 connecting the bottom (i.e. the base of the J-shape) of each recess to the periphery of the disk, facing from the convex side of the curved part of each recess.

Returning to FIG. 2A, an anti-static member 43 is provided in the coin insertion chute 33.

Two sensors, namely a sensor. 44 of inductive type and a sensor 45 of optical type are disposed in the sidewall 26 facing and close to the sites of the recesses 40 and 41. The disposition and role of these two sensors is explained below.

Figure 3:
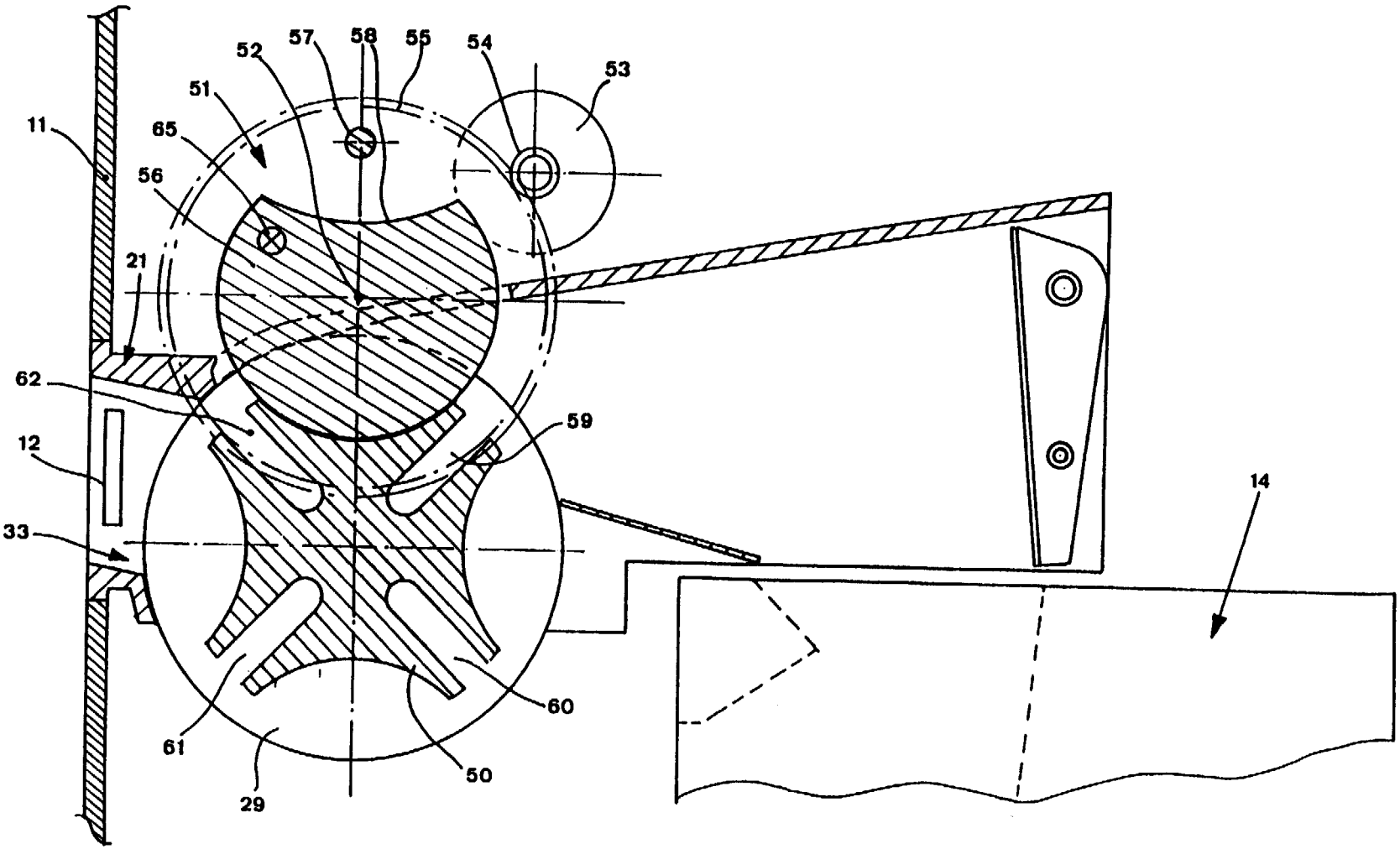
FIG. 3 is a longitudinal section of the coin input of the invention on a plane through the feed device.

Referring to FIG. 3, the means for rotating the disk 29 are now described. FIG. 3 is similar to FIG. 2A with the exception that it shows the face of the disk 29 opposite from the face of the disk shown in FIG. 2A. The opposite face of the disk 29 includes a relief pattern forming a Maltese cross with the reference 50. The rotating means for the disk 29 comprise, firstly, a toothed wheel 51 mounted to rotate about an axis 52 and, secondly, a motor 53 driving the toothed wheel 51 having teeth 55 on its periphery through a toothed pinion 54. The wheel 51 has a relief pattern with the general reference 56 on the side facing the side of the disk 29 provided with the Maltese cross. The relief pattern 56 has a diameter corresponding to the convex arcs of a circle provided in the pattern 50 of the Maltese cross on the disk 29. The wheel 51, also called the drive wheel, comprises a dog of cylindrical shape provided in a curved scallop 58 (whose concavity faces the periphery of the wheel 51) of the relief pattern 56 of the wheel 51. The dog 57 is at such a radial distance that it can cooperate with the channels 59, 60, 61 and 62 of the Maltese cross 50 located on the disk 29.

When the motor 53 is actuated, it rotates the wheel 51 and the part 56 in relief on the latter is rotated in tangential manner or edge-to-edge with one of the corresponding concave portions, until the dog 57 comes into an angular position such that it engages in one of the channels of the Maltese cross, for example the channel 59, assuming that the wheel 51 rotates clockwise. The rotation of the wheel 51 being continued, the dog engaged in the channel 59 causes rotation of the Maltese cross in the opposite sense to the wheel 51 (in the counterclockwise sense), until, in accordance with the principle of the Maltese cross, the dog 57 disengages from the channel 59 in which it has been engaged, this channel then being in a position shifted through an arc of a circle, namely a quarter turn in the example of the figure. In this second position, the channel in which the drive dog 57 was first engaged is then in a position corresponding to that of the channel 62 of FIG. 3. It is thus possible to rotate the disk 29 through given arcs of a circle, preferably a quarter of a turn. A position sensor 65 is provided on the relief part 56 of the wheel 51-and is connected to the central unit.

Figure 4:
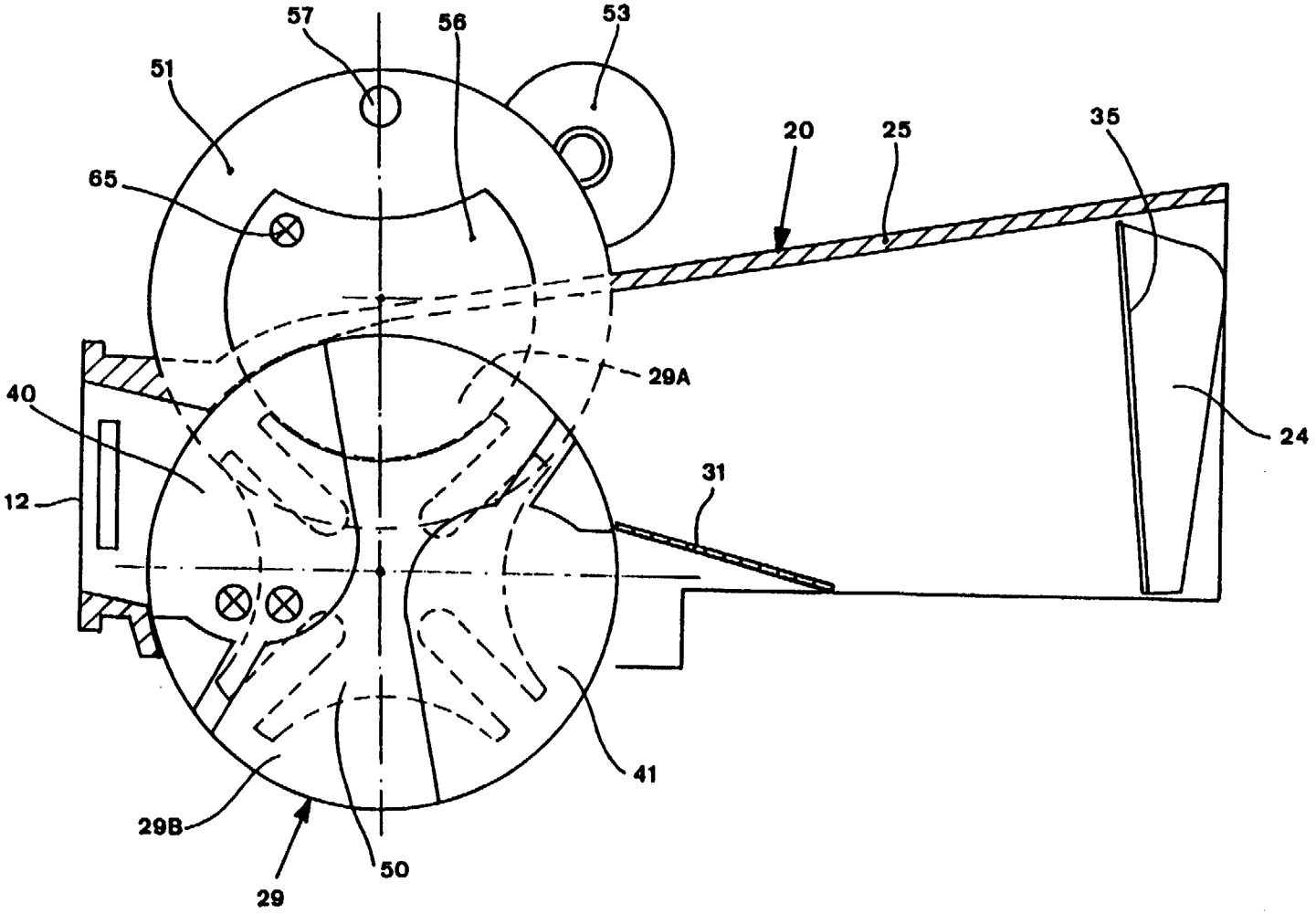
FIG. 4 is a sectional view of the same items as FIGS. 2A and 3.

FIG. 4 shows the device of FIGS. 2A and 3 and, in particular, both the Maltese cross 50 provided on one of the faces of the disk 29 and the recesses 40 and 41 (FIG. 2) provided on the other face of the disk. It will be understood that, starting from the position shown in FIG. 2A, in which the recess 40 is opposite the coin insertion chute 33, rotation through a quarter of a turn of the wheel 51 causes rotation of the disk 29 in the opposite sense by a quarter of a turn, thus placing the solid part 29A of the disk 29 opposite the chute 33, blocking the latter and thereby preventing the insertion of coins. In this second position, after rotation through a quarter of a turn, the recess 40 is then turned downwards, which causes the object that it contains to drop. Conversely, counterclockwise rotation of the wheel 51 causes clockwise rotation of the disk 29 through a quarter of a turn. Starting from the position shown in FIG. 2A, the solid part 29B of the disk 29 arrives opposite the coin insertion chute 33, preventing the insertion of coins through the window of the dispenser, and the recess 40 then comes into communication with the release space 34 provided in the rear part of the box 20, connecting the recess 40 to the coin selector 14 through the opening 28. The movement of the disk is described with reference to FIGS. 7 and 8, making clear in the greater detail the operation of the device.

Referring to FIGS. 5 and 6, the detection means for allowing pre-recognition of the object inserted in the dispenser are described below. FIG. 5 shows, in a view partially in section on a horizontal plane, the box 20 and the disk 29, with the associated detection means, with the end part of the box 20 and the disk 29 disposed beside the front panel 11 of the dispenser. The sidewall 26 of the box 20 is provided with two through holes 64 and 65 in which light-emitting diodes (hereinafter LED), namely an emitter LED 66 and a receiver LED 67, both connected to an electronic circuit board 68 connected in known manner to a source of power and to the central unit, adapted to process the information received by the said diodes 66 and 67. The recess 40 of the disk 29 is continued by a recessed part with the reference 69 in the plane of the disk. A block of transparent material forming a prism and having the reference 70 is set in the recessed part 69 and has a generally L-shaped right section. The upside down L-shaped prism 70 has a relatively short limb facing the receiving diode 67 and flush with the edge of the recess 40 (in the plane of the disk), while the longer other arm of the L-shape of the prism 70 is located in the recessed part 69, substantially in the plane of the disk. As shown in FIG. 6, the recess 69 receiving the prism 70, of generally rectangular shape as seen in the plane of the disk, is so located relative to the recess 40 that one part of the recessed part 69 passes in front of the recess 40. The remainder of the recessed part 69 does not open into the recess 40, in order that the receiving diode 67 shall not face the recess 40.

A sensor 71 of inductive type is also provided, fitted in a seat provided in the sidewall 26 of the box 20. The inductive sensor 71 is also connected to the electronic circuit board 68 and is offset radially relative to the diodes 66 and 67 in the direction of the coin insertion slot 12. Thus, starting from the position shown in FIG. 2A, i.e. in which the recess 40 is adapted to receive an object and faces the chute 33, a coin 73 inserted through the slot 12 passed into the interior of the box 20 and, more particularly, comes to rest in the recess 40. The inductive sensor 71, previously put into operation by the central unit on receiving information from the user relative to the choice of travel ticket desired, sends information via the electronic circuit board 68 to the central unit, of such a nature as to allow verification of the material of the inserted object, namely whether it is a metallic material. With the coin 73 being located in the recess 40, the emitting diode 66 faces the coin. The emitter diode is actuated in such a manner as to emit light which is then blocked by the coin and is, thus, not received by the receiving diode 67, which confirms the presence of an opaque object. The combination of the information of an object judged to be opaque and of metallic material leads to the conclusion that it conforms at least as regards these two criteria to the inserted object being a coin. In case the inserted object is not of metallic material, the inductive sensor 71 emits a corresponding signal. In case a metallic object is inserted, like a paper clip for example, the inductive sensor sends a conformity signal, since the object is indeed of metallic material, but the optical sensor (formed by the two emitting and receiving diodes) sends a signal of non-conformity, because the receiving diode receives the light emitted by the emitting diode, via the prism 70. Likewise, cardboard with a circular shape inserted into the slot 12 causes a signal of non-conformity to be given by the inductive sensor, although the optical sensor emits a signal of conformity (opacity).

The sensor device provided by the invention is sufficiently simple to remain economical, while allowing reliable pre-recognition of inserted objects. Also, the sensors are located inside the apparatus, relative to the slot, in such a manner that they are relatively protected and are, thus, not vulnerable to attempts at damaging them in order to put them out of action. In any event, an attempt at damaging the sensors equally causes damage to the system as a whole and makes any acts of vandalism in this respect useless.

The operation of the apparatus is described below with reference to FIGS. 7A to 7D, showing the device in a schematic manner, in side view, in various positions of the disk corresponding to different stages of feeding the coin inserted into the coin input device of the invention.

Figure 7A:
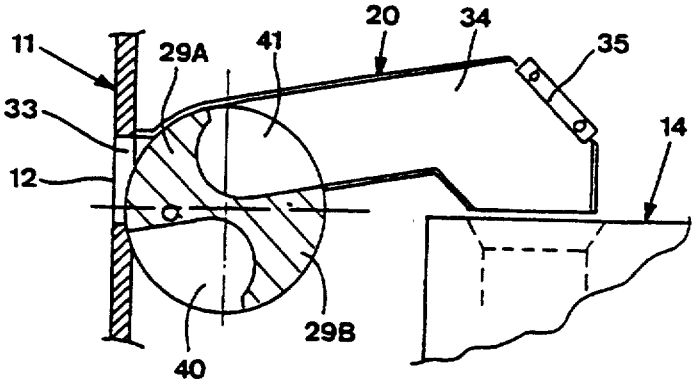
FIGS. 7A, 7B, 7C and 7D show the successive positions of the disk carrying coins during the feed of the coins towards the selector.

In the position shown in FIG. 7A, the device is "ready", that is to say the disk is so positioned that one of the solid parts 29A (or 29B) faces the coin insertion chute 33, thus preventing insertion of any object into the dispenser. This ready, or standby, position corresponds to the period of use of the apparatus between two successive transactions or to when the apparatus is out of service.

Figure 7B:
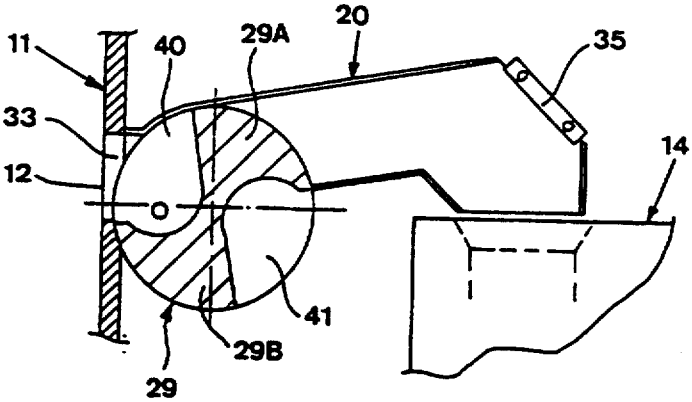

Assuming that a user selects a transaction type, for example a travel ticket, and gives the apparatus, i.e. the central unit, the necessary information to define a particular ticket, the central unit then determines the corresponding amount and commands rotation of the disk 29 in such a manner that one of the recesses, for example the recess 40, faces the insertion chute 33 and thus the slot 12. The position shown in FIG. 7B is reached, in which the coin insertion device is able to receive an object inserted by the user.

Figure 7C:
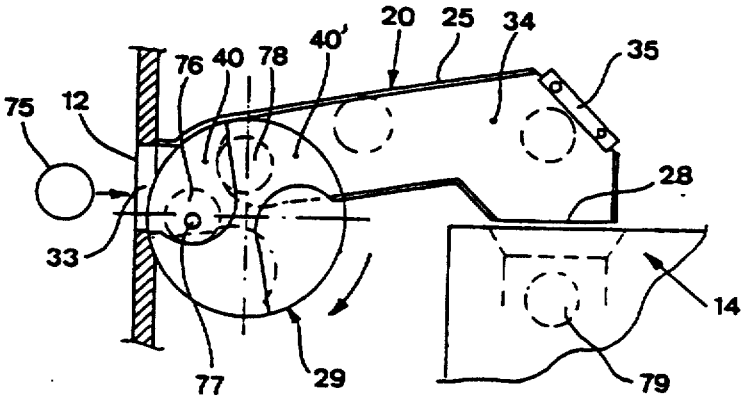

Referring to FIG. 7C, the object, namely a coin 75 is inserted into the slot 12 and, after passing through the insertion chute 33, comes to rest in the recess 40 of the disk 29, where the coin is shown in broken lines with the reference 76. The set of sensors 66, 67 and 71 symbolized by the sole reference 77, sends a signal of conformity to the central unit, which in its turn, commands clockwise rotation of the disk 29 through a quarter of a turn (as shown in and explained with reference to FIGS. 3 and 4). The rotation of the disk 29 causes the recess 40 to pass from the position shown in full lines in FIG. 7C to the position offset by a quarter of a turn with the reference 40' and shown in broken lines in FIG. 7C. The coin shown in broken lines with the reference 78 in the recess 40' (in broken lines) is subjected to this movement and, once the disk 29 stops in the position shown in broken lines, leaves the receptacle 40'undergoing acceleration and, thus, rebounding from the top wall 25 of the box 20, then against the blocking wall 35 at the end 23 of the box 20, and then leaves the latter to pass through the opening 28 provided in the coin selector 14 (coin shown in broken lines with the reference 79).

Figure 7D:
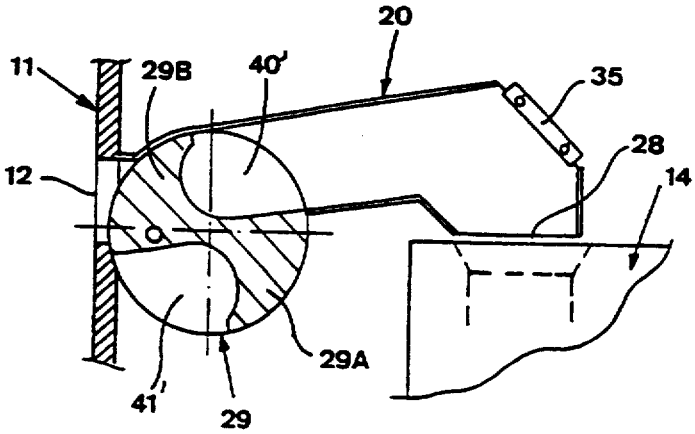

FIG. 7D shows the position of the disk 29 once the coin has left the recess 40'. The solid part 29B faces the slot 12 and, thus, blocks the same. Note that the position shown in FIG. 7D is offset by half a turn relative to that shown in FIG. 7A, the positions shown in FIGS. 7A and 7D being equivalent from a mechanical point of view and from the operating point of view since, in one case, it is the solid part 29A which blocks the slot 12 while, in the other case, it is the part 29B which plays the same role. In these two positions, the apparatus is "ready" or on standby and only a command from the central unit can cause the rotation of the disk 29 to allow one of the recesses 40 and 41 to be positioned facing the slot 12 and the coin insertion chute 33.

It is important to note that the disk and each recess with which it is provided act in the manner of a lock chamber, in that the interior space defined by the recess is in communication either with the insertion chute 33 or with the release space 34 opening into the selector 14.

The disposition of two recesses diametrically opposite one another allows the rotary movement of the disk 29 to be restricted, which can thus present either a solid part or a recess opposite the slot 12 by successive rotations through a quarter of a turn.

The above description with reference to FIGS. 7A to 7D corresponds to operation of the apparatus when the inserted object is judged to conform to a coin.

Figure 8A:
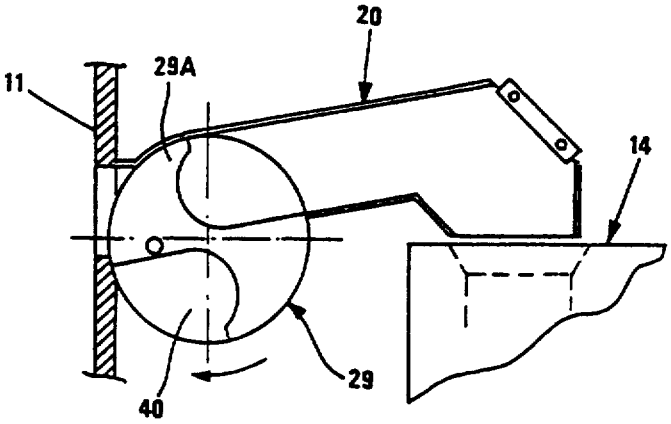
FIGS. 8A, 8B and 8C show the device of the invention in side view for successive positions of the disk when ejecting non-conforming objects.
Figure 8B:
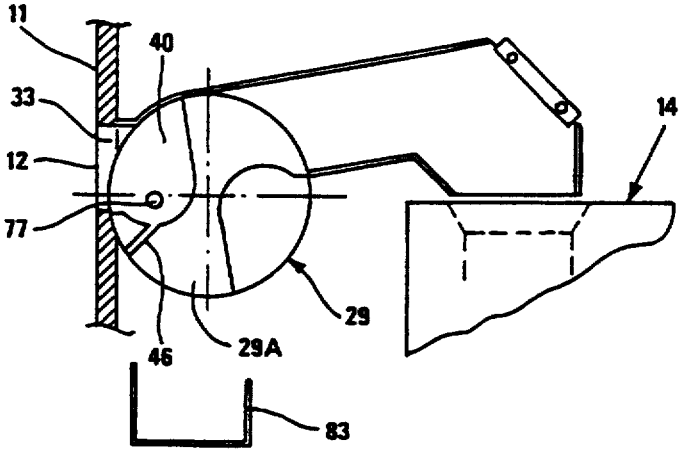
Figure 8C:
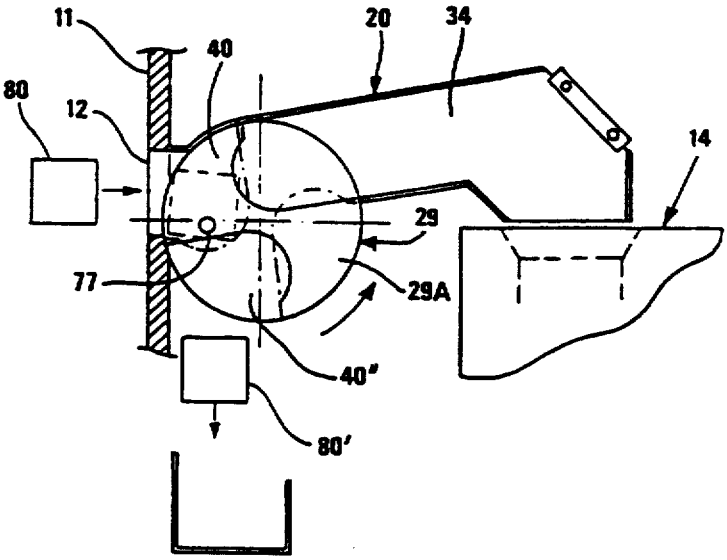

FIGS. 8A, 8B and 8C show, as is described below, the operation of the apparatus when the inserted object does not conform or is not so adjudged. The parts of FIG. 8 similar to those of FIG. 7 carry the same reference numerals. Note in this respect that FIGS. 7 and 8 show an embodiment which is slightly modified in the rear part of the box 20 relative to the embodiments shown in FIGS. 2A, 3 and 4; this merely constitutes a variant.

FIG. 8A is equivalent to FIG. 7A in the sense that the disk is in a position such that the solid part 29A blocks the slot 12, the apparatus being in the watching or standby position.

In FIG. 8B the central unit has caused rotation of the disk 29 in such a manner that the recess 40 faces the insertion chute 33, and thus the slot 12, and the position shown in FIG. 7B is reached. The reference 77 represents the set of sensors both optical 66, 67 and inductive 71 in a symbolic manner.

Assume that an object 80 which does not conform, that is to say an object which is not a coin, is introduced through the slot 12 and lodges in the recess 40 of the disk 29. The set of sensors 77 then, after detection, sends signals carrying the information that the inserted object does not conform and the central unit then commands rotation of the disk in the sense opposite to that shown in the FIGS. 7, that is to say in counterclockwise sense, thus causing the recess 40 to pass from the position 40 (broken lines) to the position 40" (full lines), in which the recess 40" presents its opening and its concavity towards the bottom, which causes the object, with the reference 80', to fall towards the ejecting or storage means having the general reference 83 and known per se.

In addition, as is shown in FIG. 8B, the bottoms of the recesses are connected by channels, of which only the channel 46 has been shown, connecting the bottom of the recess 40 to the periphery of the disk 29. For reasons of clarity only the one channel has been shown in FIG. 8B but it will be understood that the channels 46 and 47 shown in FIGS. 2A, 3 and 4 are provided in the disk 29.

The channel 46 opens more particularly in the position shown in FIG. 8B, in which the recess 40 is adapted to receive an object, towards the bottom and thus towards the means 83 for storage or ejection of non-conforming objects. The channel 46 is more particularly intended to evacuate liquids which may be introduced via the slot 12, and especially corrosive liquids such as acids introduced by fraudsters with a view to trying to prevent the operation of the device or to cause malfunction thereof in order to put the dispenser in a state of returning money for example.

Note that, with reference to the FIGS. 8A to 8C, the ejection of non-conforming objects is effected well in advance of the coin path, since the non-conforming object is not allowed to penetrate into the interior of the coin path and in any event to the interior of the release space 34 in the interior of the box 20 and opening into the selector 14.

The coin input of the invention also has advantageous features according to which the coin insertion passage 33 is located at a level (in a vertical plane) lower than the level (in terms of height) than the discharge of the coin at the outlet of the box 20. FIGS. 2A, 3, 4 and especially 7 and 8 show this feature, which allows the total height of the apparatus to be reduced.

This is particularly important having regard to the constraints established by the standards mentioned in the introduction, according to which the coin insertion slot should be located at a height of 1.3 m above the ground maximum while the return change tray should be located at 0.65 m at the least. Thus, thanks to the invention, as can be ascertained in particular from FIGS. 7A to 7D and 8A to 8C, the coin insertion passage 33 is located at substantially the same level as the opening 28 of the selector 14. This means that the coin input of the invention allows pre-recognition of coins, ejection of non-conforming objects and feeding the coin to the selector 14 without loss of height and even with a slight gain. This is particularly advantageous compared with the prior art and especially when compared with known devices ensuring discharge of coins towards the selector by gravity.

I claim:

1. A device for verifying the conformity of objects inserted through an opening as payment in a dispenser that dispenses at least one of a product and a service, and for directing the objects toward means for processing the objects, the device comprising:

means for verifying the conformity of objects before being directed to the processing means;

directing means, responsive to the verifying means, and including a positioning member with a receptacle adapted to receive the objects, said member being movable between a first position in which said receptacle communicates with said opening, access to the processing means then being blocked, and a second position in which said receptacle communicates with said processing means, the opening then being blocked;

means for ejecting non-conforming objects;

wherein said member is movable to put said receptacle in communicates with either said processing means or with said means for ejecting non-conforming objects; and wherein the directing means is adapted to feed said objects toward said processing means substantially without loss of height.

2. A device according to claim 1, wherein said member is mounted to rotate about an axis transverse to a plane of said objects.

3. A device according to claim 1, wherein said verifying means face said receptacle for objects when this receptacle communicates with said opening.

4. A device according to claim 1, wherein said means for verifying the conformity of objects include a sensor of an optical type.

5. A device according to claim 1, including a duct adapted to evacuate liquid and connecting said receptacle to said ejecting means.

6. A device according to claim 1, wherein an entrance to the processing means is located at a level which is at or above a base of said opening.

7. A device according to claim 1, wherein the directing means is adapted to feed said objects toward said processing means without loss of height.

8. A device according to claim 1, further comprising a release space through which said member communicates with the processing means while in said second position.

9. A device according to claim 1, wherein said means for verifying the conformity of objects includes a sensor of an inductive type.

10. A device according to claim 1, wherein the member comprises a disk provided with a recess which opens at the periphery of said disk, said disk being adapted to be rotated through an arc of a circle.

11. A device according to claim 10, wherein said disk has two diametrically opposed recesses.

12. A device according to claim 10, wherein the disk is adapted to be rotated in two opposite senses.

* * * * *